US006193017B1

(12) United States Patent
Köster

(10) Patent No.: US 6,193,017 B1
(45) Date of Patent: Feb. 27, 2001

(54) PULLEY-DRIVEN ELEVATOR

(75) Inventor: Regina Köster, Abenberg (DE)

(73) Assignee: Blain Hydraulics GmbH (DE)

( * ) Notice: Subject to any disclaimer, the term of this patent is extended or adjusted under 35 U.S.C. 154(b) by 0 days.

(21) Appl. No.: 09/242,166

(22) PCT Filed: Aug. 13, 1997

(86) PCT No.: PCT/EP97/04424

§ 371 Date: Feb. 10, 1999

§ 102(e) Date: Feb. 10, 1999

(87) PCT Pub. No.: WO98/06655

PCT Pub. Date: Feb. 19, 1998

(30) Foreign Application Priority Data

Aug. 14, 1996 (DE) ..... 196 32 850

(51) Int. Cl.[7] ..... B66B 11/08

(52) U.S. Cl. ..... 187/258; 187/256; 187/264; 187/266

(58) Field of Search ..... 187/258, 254, 187/256, 264, 266, 350

(56) References Cited

U.S. PATENT DOCUMENTS

| | | | | |
|---|---|---|---|---|
| 664,041 | * | 1/1900 | Hadfield | 187/256 |
| 998,629 | | 7/1911 | Neenan . | |
| 2,537,075 | * | 1/1951 | Margles | 187/264 |
| 2,835,345 | | 5/1958 | Beck . | |
| 3,127,957 | * | 4/1964 | Nelson | 187/264 |
| 4,108,280 | * | 8/1978 | Eastcott et al. | 187/256 |
| 5,149,922 | | 9/1992 | Kondou . | |
| 5,323,878 | * | 6/1994 | Nakamura et al. | 187/266 |
| 5,437,347 | * | 8/1995 | Biewald et al. | 187/264 |
| 5,526,901 | * | 6/1996 | Salmon | 187/266 |
| 5,566,783 | | 10/1996 | Yamashita . | |
| 5,636,713 | | 6/1997 | Perkins et al. . | |
| 5,788,018 | * | 8/1998 | Mendelsohn et al. | 187/266 |
| 5,861,084 | * | 1/1999 | Barker et al. | 187/264 |

FOREIGN PATENT DOCUMENTS

| | | | | |
|---|---|---|---|---|
| 105613 | | 1/1897 | (DE) . | |
| 1 251 926 | | 10/1967 | (DE) . | |
| 6 752 271 | | 9/1968 | (DE) . | |
| 1 506 478 | | 10/1969 | (DE) . | |
| 0 565 516 | | 10/1993 | (EP) . | |
| 326895 | | 12/1902 | (FR) . | |
| 92686 | * | 12/1968 | (FR) | 187/264 |
| 2 308 578 | | 11/1976 | (FR) . | |
| 1 442 584 | | 7/1976 | (GB) . | |
| 405338958 | * | 12/1993 | (JP) | 187/264 |

* cited by examiner

*Primary Examiner*—Robert P. Olszewski
*Assistant Examiner*—Paul T. Chin
(74) *Attorney, Agent, or Firm*—Anthony J. Casella; Gerald E. Hespos; Michael J. Porco

(57) ABSTRACT

A traction-sheave elevator is provided without a counterweight. The elevator includes an elevator car that is guided in an elevator shaft. A rope is used to carry the car. The elevator further include at least two motor-driven traction-sheaves that are connected one behind the other relative to the rope. The rope wraps around each traction-sheave to define a relative angle of wrap greater than 180°. A tensioning device is connected downstream of the traction-sheaves for self-adjustably applying a requisite tension to the rope after the rope comes off the second traction-sheave. Additionally, a braking device is provided for at least one of the traction-sheaves.

8 Claims, 8 Drawing Sheets

PULLEY-DRIVEN ELEVATOR

BACKGROUND OF THE INVENTION

1. Field of the Invention

The invention relates to elevators in general, and in particular to a traction-sheave elevator which has no mechanical counterweight running with it.

2. Description of the Invention

The most diverse types of elevators for the conveyance of passengers and/or loads are known and are used extensively. Elevators can generally be divided into three classes: traction-sheave or rope elevators, hydraulic elevators, and special solutions, such as, for example, rack, chain or spindle-gearing elevators. Furthermore, combined forms are also known, such as, for example, a hydraulic rope elevator, which is actuated via a piston-cylinder arrangement and interposed ropes.

In the case of traction-sheave elevators or rope elevators, a load-conveying means, in particular an elevator car, is suspended on a rope which is run over a so-called traction sheave. The traction sheave is motor-driven in order to move the car up or down. A counterweight, which as a rule is heavier than the load-conveying means, is normally arranged on the other end of the carrying means or rope. In order to set the load-conveying means and the counterweight in motion, there must be sufficient friction between the carrying rope and the traction sheave. The rope friction required for the drive is determined, on the one hand, by the configuration of the traction sheave, the rope and the number of ropes and, on the other hand, by the applied pressure of the rope against the traction sheave, this applied pressure in turn depending on the rope tension and thus on the weight of the load-conveying means and on the counterweight. The counterweight is normally designed in such a way that it corresponds approximately to the weight of the load-conveying means plus half the maximum useful load. Common counterweights are made of steel, reinforced concrete or the like and require a very large space in the elevator shaft on the one hand and robust guide rails for the spatial fixing on the other hand. This spatial guidance in the elevator shaft is costly and requires considerable material. In particular, it is often necessary to provide speed limiters and catching devices for the counterweight, which entail further constructional measures with requisite space, costs and material. Furthermore, the response behavior of the elevator is greatly impaired by the combined high moment of inertia of the load-conveying means and the counterweight.

During the modernization of existing elevator installations or during the integration of new elevators in existing buildings, in particular old buildings, apart from government conditions there is also often only a restricted space available.

A traction-sheave elevator without counterweight is disclosed by German Patent 105 613. In the traction-sheave elevator of the generic type, a manually adjustable tensioning device acts on a section of a carrying means. The tension force introduced into the carrying means is distributed uniformly to the two traction sheaves via deflection pulleys and a further carrying means closed upon itself.

The journal Liftreport, No. 2, 1990, pages 6–8 discloses a traction-sheave elevator which has no counterweight and in which a traction sheave is provided which, in combination with the driving gear, is arranged so as to hang as tension weight at the bottom in the ropes.

The object of the invention is to develop a traction-sheave elevator of the generic type without counterweight and having two traction sheaves in such a way that a high degree of safety in operation, in particular a high traction capacity, is ensured, while the elevator is to have dimensions which are as compact as possible, a reduced number of parts and reduced manufacturing and installation costs.

SUMMARY OF THE INVENTION

In the traction-sheave elevator according to the invention, the tensioning device is self-regulating, i.e. self-acting or self-adjusting in the event of any elongation of the carrying means. Furthermore, the angle of wrap of the carrying means relative to each traction sheave, according to the invention, is greater than 180°, i.e. the angle of wrap less any integral multiple of 360° is greater than 180°. Finally, the traction-sheave elevator according to the invention has at least one braking device for at least one of the traction sheaves in order to further increase the safety of the elevator in operation. Since the tensioning device acts on the carrying means after the latter runs off from the second traction sheave, the force introduced acts directly as applied pressure of the carrying means relative to the traction sheave, so that a lower stress overall on the elevator shaft or the building to be equipped can be achieved.

The traction-sheave elevator without counterweight, which is guided in an elevator shaft, preferably has a load-conveying means, a flexible carrying means, at least two motor-driven traction sheaves, and a tensioning device, which introduces a requisite tension into the carrying means. In particular, the load-conveying means is an elevator car and the flexible carrying means are, in particular, ropes, which are wound one after the other around the two traction sheaves. Due to the provision of two traction sheaves in combination with the carrying-means-tensioning device connected downstream, the static friction produced between the carrying means and the traction sheaves is greater than the force due to the weight of the load-conveying means at maximum loading, as a result of which the use of a voluminous and heavy counterweight may be dispensed with, in which case the admissible loading limits of the carrying means and of the traction sheave, in particular the traction-sheave groove, are not exceeded. By the omission of the counterweight, the risk of an elevator suddenly moving upward is advantageously eliminated, this risk occurring in conventional traction-sheave elevators, in particular due to the fact that the counterweight is normally designed to be heavier than the load-conveying means.

The elevator according to the invention permits a very compact type of construction, in which case, in particular, all the components may be accommodated in the elevator shaft itself.

The requisite rope tension may be provided via a tensioning device provided at one rope end, e.g. a hydraulic or pneumatic tensioning device, which may be installed, for example, at the bottom of the elevator shaft. However, the requisite tension of the carrying means is in particular preferably achieved via a deflection sheave to which force is applied, in which case the deflection sheave to which force is applied may likewise serve to increase the angle of wrap of the carrying means around the traction sheaves.

In a preferred refinement of the traction-sheave elevator according to the invention, in each case an end of the carrying means is connected to the load-conveying means. Therefore each section of the carrying means is moved at the same speed as the load-conveying means. The fastening of the ends of the carrying means is preferably designed in one piece for both ends, i.e. the carrying means in particular preferably forms a closed loop. Alternatively, separate attachment locations may also be provided for the two ends of the carrying means, in which case these attachment locations may in particular be displaced from one another in order to compensate for a displaced center of gravity if need be. In the case of a displaced fastening of the ends of the carrying means on the load-conveying means, care should be taken during the design to ensure that that end of the carrying means which continues upward is attached essentially above the center of gravity of the load-conveying means.

Alternatively, it is preferred that in each case an end of the carrying means be fastened to the bottom of the elevator shaft and to the top end of the elevator shaft, as a result of which a stationary carrying means is formed. This arrangement is especially advantageous, since less material is required for the carrying means. Furthermore, with this arrangement, the complete drive apparatus, if need be including the elevator control system, may be fastened to the load-conveying means, i.e. all the movable parts may be located on the load-conveying means and are therefore easy to install and maintain, a machine room or the like being required neither at the top end nor at the bottom end in order to accommodate the elevator machinery.

The traction-sheave elevator preferably has at least one further traction sheave, on the one hand in order to ensure better symmetry of the run of the carrying means and on the other hand in order to increase the angle of wrap of the traction sheaves. A deflection pulley is in particular preferably provided on the load-conveying means in order to suspend the load-conveying means indirectly or like a block and tackle, so that the force produced by the load-conveying means is in each case distributed in equal proportions to two carrying-means sections running upward. This deflection pulley is preferably designed as a freewheeling deflection pulley and/or as a double deflection contrarotating pulley, in which case it may have the same or if need be different radii. By the provision of such a deflection pulley on the load-conveying means, it is possible to reduce the dimensions and ratings of the other components; in particular, it is sufficient for the drive apparatus, at twice the rotary speed or at twice the traction capacity, to provide virtually only half the drive torque.

The traction sheaves of the elevator may be driven via a common motor, with the use of a suitable transmission gearing, if need be with a coupling for the two traction sheaves; however, it is preferred that each individual traction sheave be driven via a separate motor. Here, in particular electric motors, hydraulic motors and the like may be used. In particular, a hydraulic motor, which permits as quiet an operation as possible due to the fact that there is no gearing arrangement, is currently preferred. The motor may also serve as a braking device and is in this case preferably connected to an accumulator so that the braking energy produced during the lowering travel of the load-conveying means is stored for a subsequent elevating operation. Therefore the motor acts as a braking device in the manner of a generator, in which case the energy produced may partly be stored in a suitable accumulator, such as, for example, a pressure or hydraulic accumulator in the case of a hydraulic motor, although in the case of an electric motor, for example, a battery or another suitable storage means may also be used. An energy-efficient elevator can thus be provided, and this elevator, apart from the efficiency, the storage losses and/or the requisite drive power, essentially corresponds to an elevator with a counterweight but without having the disadvantages, in particular the spatial requirements of a counterweight elevator.

Force is applied to the carrying-means-tensioning deflection sheave preferably via a lever mechanism provided with a weight, a hydraulic device, a pneumatic device or via an electric motor. Depending on the requirement, the application of force may therefore be controlled or set, in which case an elongation of the carrying means due to material fatigue may likewise be compensated for. In an especially advantageous manner, the traction sheaves and the carrying-means-tensioning device may therefore also be attached so as to be spatially separate from one another. Furthermore, it is preferred that the tension produced in the carrying means, i.e. in particular the force acting on the carrying-means-tensioning deflection sheave, be a function of the useful load of the load-conveying means. For this purpose, a weight-detection device is provided in or on the load-conveying means and is connected to a control device mechanically or electrically or in another way, and this control device in turn determines the requisite carrying-means tension and introduces the latter into the carrying means via the tensioning device.

The traction-sheave elevator is preferably provided with a carrying-means-tension-detection device, which activates a safety device if the carrying-means tension falls below a predetermined value. In particular, if the carrying-means tension decreases, the motion of the load-conveying means is arrested, e.g. by latches or catches which are provided in the guide of the load-conveying means and are directly activated as a safety device if the carrying-means tension has dropped below a predetermined value.

The carrying-means-tensioning device is preferably provided at the bottom of the elevator shaft.

The traction sheaves of the traction-sheave elevator are preferably firmly arranged in the top section or above the top section in a machine room provided for this purpose, but may likewise be installed at the bottom end or below the elevator shaft, if the spatial conditions accordingly require this.

The carrying-means-tensioning device and/or the traction sheaves may also be fastened to the load-conveying means itself, i.e. may move with the latter. In particular, the individual sheaves may be combined to form a carrying-means-tensioning drive unit, which is fastened as a body to the load-conveying means. The requisite construction space can be further reduced by such an arrangement of the traction sheaves and/or the tensioning device. Furthermore, the height of the elevator shaft may be optimally utilized in such a configuration.

The carrying means preferably runs around the traction sheaves one after the other with in each case an angle of wrap of 180°, which is preferably up to 270°. This large angle of wrap ensures that, even when the load-conveying means is heavily loaded, the starting and braking are reliably ensured without the carrying means sliding relative to the traction sheaves, even at high speeds. A rapid response of the elevator machinery is therefore ensured.

The motor drive of the traction sheaves may likewise be used as a braking device; however, it is preferred that a separate braking device be provided for at least one of the traction sheaves in order to brake the motion of the traction sheave and thus the motion of the load-conveying means driven via the traction sheave and the carrying means and in particular to secure the position of the load-conveying means.

Finally, it is preferred that the tensioning device, the traction sheaves and the carrying means extend in one plane, which is arranged next to and/or behind the load-conveying means. Therefore space is required neither below nor above the utilizable shaft height, so that an even more compact configuration of the elevator according to the invention is made possible.

Further features and advantages of the traction-sheave elevator according to the invention follow from the detailed description below of some preferred embodiments, which are considered to be merely exemplary and non-restrictive, and with reference to the attached drawing.

DETAILED DESCRIPTION OF THE PREFERRED EMBODIMENTS

Figure 1:
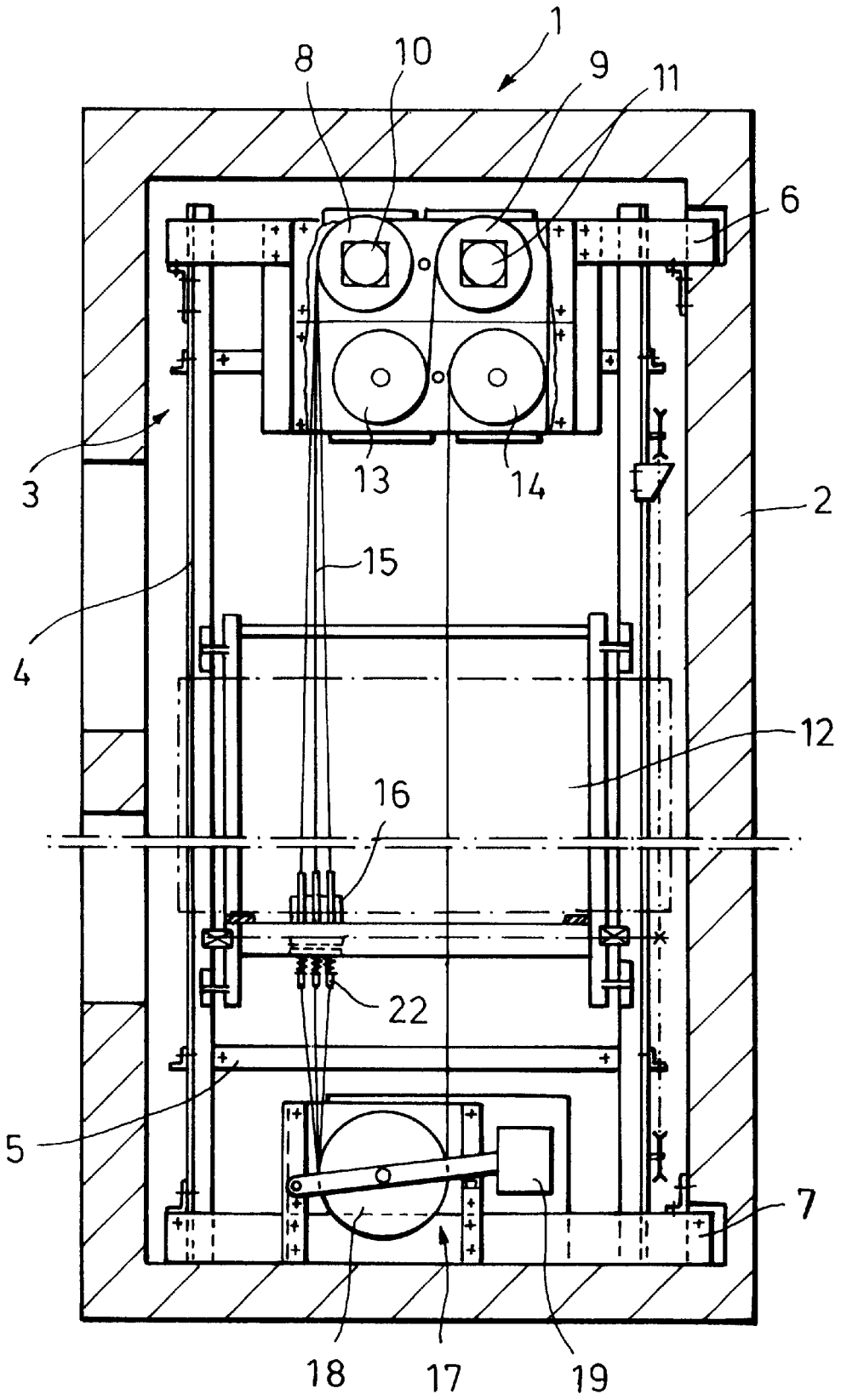
FIG. 1 shows a longitudinal sectional view of an elevator shaft in which a preferred traction-sheave elevator according to the invention is arranged.

An elevator shaft 1 formed from walls 2 is shown without machine room in FIG. 1. Installed in the shaft 1 is a frame-shaped supporting structure 3, which has two guide rails 4, a plurality of brackets 5 and two cross members 6 and 7. The cross members 6 and 7 are let into the walls 2 essentially in the top and bottom end of the shaft 1 or are mounted on guide rails and extend essentially over the entire shaft width. Extending between the cross members 6 and 7 are guide rails 4, which guide a load-conveying means, an elevator car 12 in the embodiment shown, in such a way that it can be moved up and down. The elevator car 12 is connected at 16 to one end of a carrying means 15. In the embodiment shown, the carrying means 15 is formed from three steel ropes, which at the fastening point are fastened to the elevator car at a slight distance relative to one another. Starting from the elevator car 12, the carrying means 15 extends essentially perpendicularly upward to a first traction-sheave 8, which is driven via an electric motor 10. The carrying means 15 wraps around the traction sheave 8 and is extended via a deflection sheave 13 to a second traction sheave 9 having a second driving electric motor 11. Starting from the second traction sheave 9, the carrying means 15 is run downward over a further deflection sheave 14. In the embodiment shown, the traction sheaves 8, 9 and the deflection sheaves 13, 14 are mounted on the top cross member 6 via a frame structure. After the second deflection sheave 14, the carrying means 15 runs essentially perpendicularly downward to a tensioning device 17. In the embodiment shown, the tensioning device 17 comprises a deflection sheave 18, to which force is applied by a weight 19 via a lever mechanism. The carrying means 15 is wound around the deflection sheave 18 and is likewise fastened with the other end to the elevator car 12. In the embodiment shown, the second end is fastened to the elevator car 12 via a release spring mechanism 22, which, in the event of breakage of one of the ropes, activates a catching device, which prevents the elevator car 12 from being moved if one of the carrying ropes fails.

Figure 2:
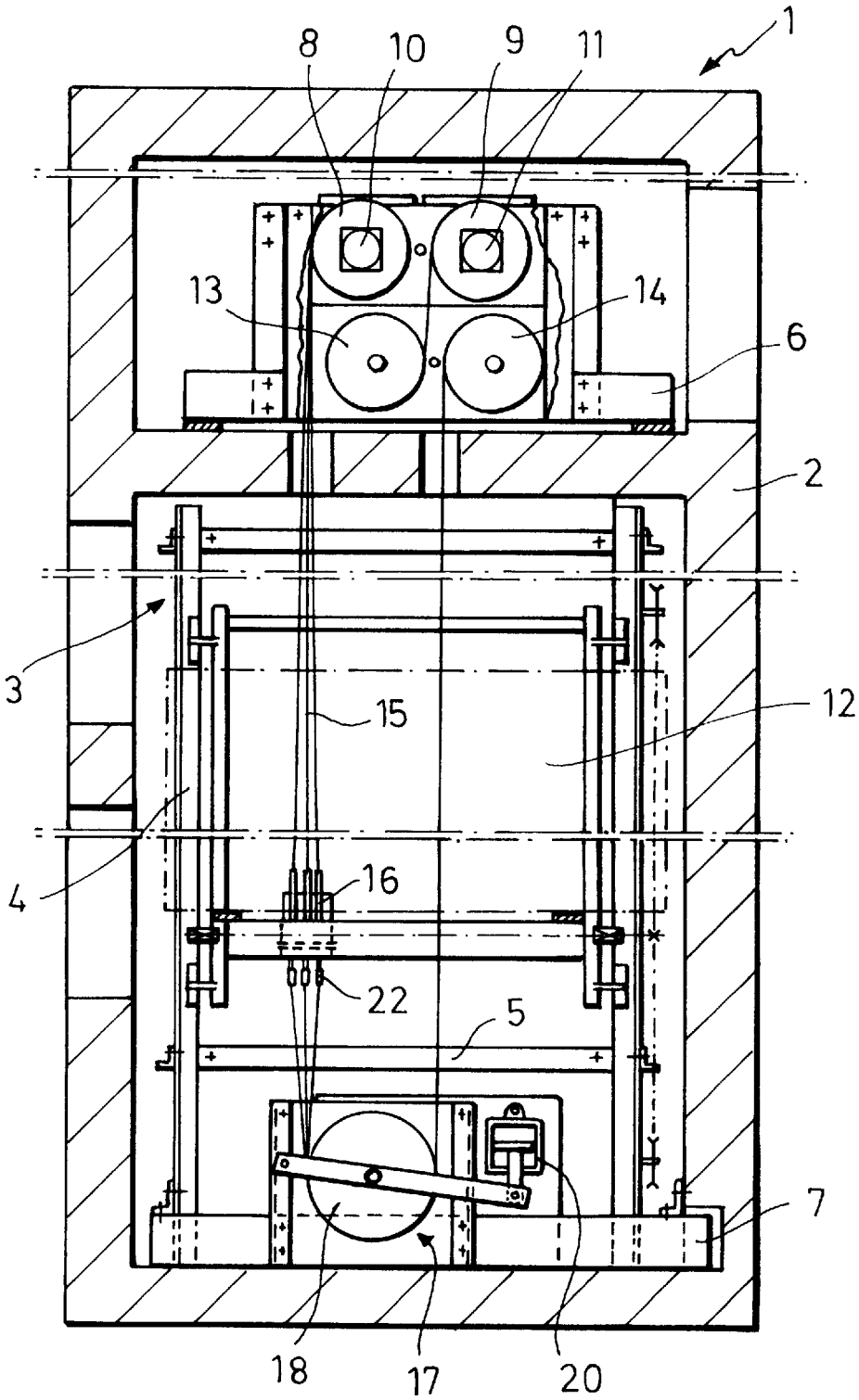
FIG. 2 shows a view similar to FIG. 1, although a machine room is provided above the elevator shaft, and an alternative embodiment of the traction-sheave elevator according to the invention is installed in the machine room and the elevator shaft.

The embodiment shown in FIG. 2 is generally similar to the embodiment shown in FIG. 1 and the description of the same components is omitted herein for the purpose of brevity. In the embodiment which is shown in FIG. 2, the traction sheaves 8, 9 with the associated motors 10, 11 as well as the deflection sheaves 13 and 14 are accommodated in a machine room located above the elevator shaft. Furthermore, in the embodiment shown in FIG. 2, force is applied to the carrying-means-tensioning device 17 via a hydraulically or pneumatically controlled cylinder 20. In particular in the case of a hydraulically or pneumatically controlled tensioning device, a rope tension which is a function of the useful load can be obtained in a simple manner via a control system (not shown).

Figure 3B:
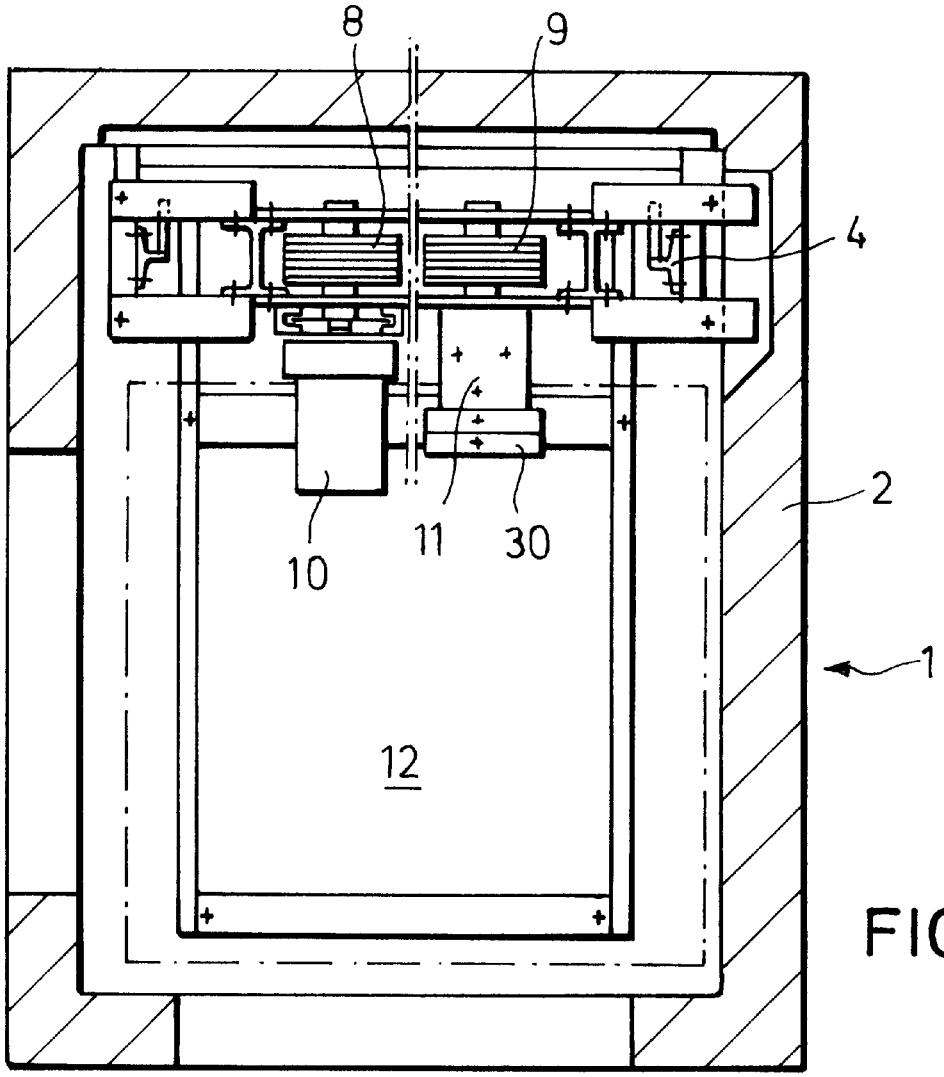
FIGS. 3A and 3B show cross-sectional views through the shaft shown in FIG. 1 and FIG. 2 respectively, FIG. 3A showing the details of the motor-driven traction sheaves and FIG. 3B showing details of the tensioning device.
Figure 3A:
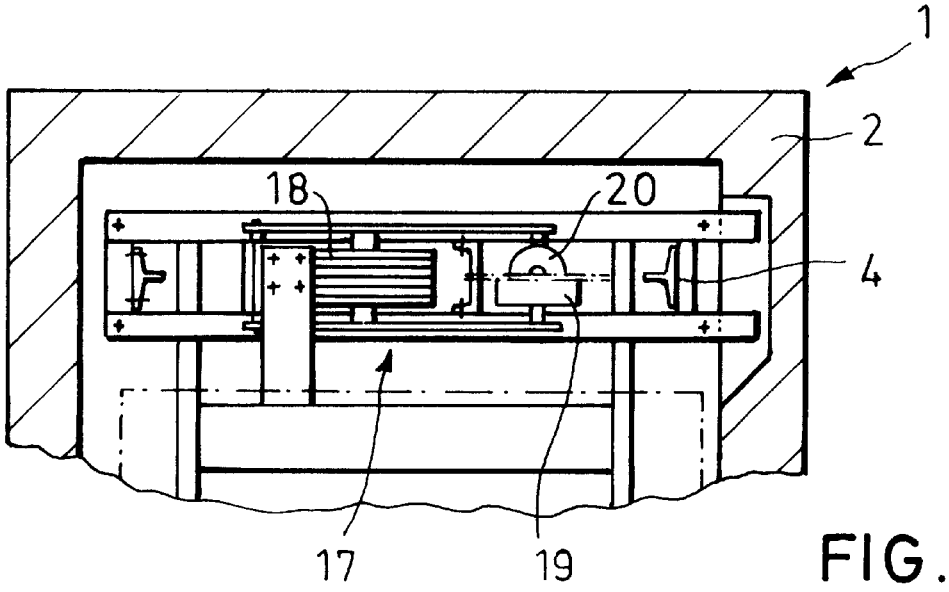

The cross-sectional views of FIGS. 3A and 3B show that the carrying means 15, the traction sheaves 8, 9 and the tensioning device 17 are essentially installed next to the elevator car 12 in or on the elevator shaft 1, in which case sufficient space remains for the elevator car 12, and the elevator car 12 cannot be hit by a traction sheave or deflection sheave plummeting downward. Furthermore, FIGS. 3A and 3B show that the traction sheaves 8, 9 and the deflection sheave 18 of the tensioning device 17 are designed for guiding a plurality of ropes, which together form the carrying means 15. In an especially preferred embodiment (not shown), the tensioning device in each case has a separate mounted sheave for one rope each of the carrying means, so that each component of the carrying means, taken by itself, can be given a specific rope tension, as a result of which coarser production tolerances may be set during the manufacture of the carrying means.

In the cross-sectional views of FIGS. 3A and 3B, an electric motor 11 is replaced by a hydraulic motor 11, a braking device 30 also being provided for the traction sheave 9. Furthermore, the tensioning device here is shown with both a weight 19 and a pneumatic or hydraulic tensioning cylinder 20.

Figure 4:
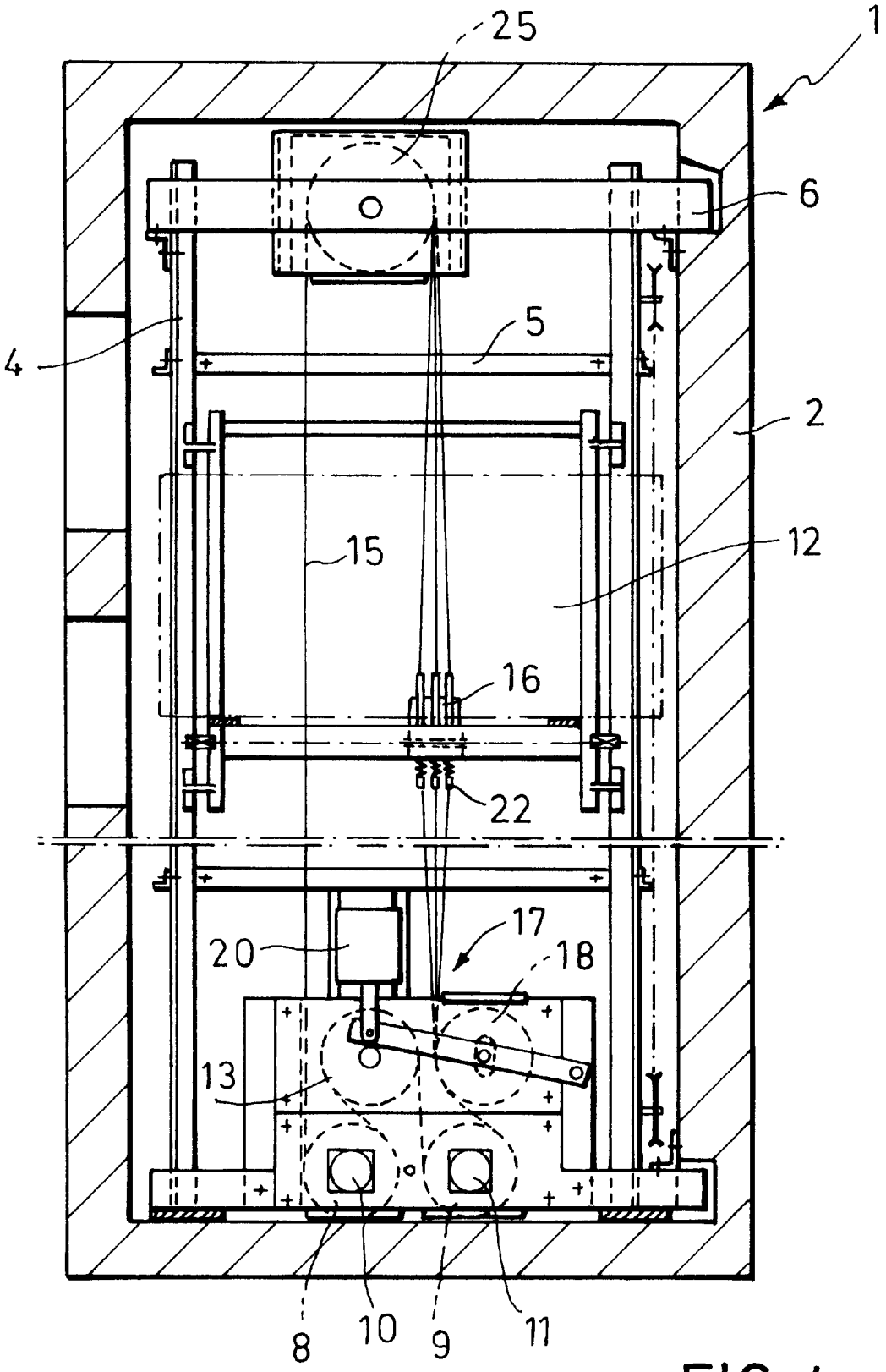
FIG. 4 is a longitudinal sectional view similar to FIG. 1, although an alternative embodiment of the traction-sheave elevator according to the invention is installed.

In the embodiment shown in FIG. 4, the traction sheaves 8, 9 are installed at the bottom end of the elevator shaft 1, whereas only one further freewheeling deflection sheave 25 is provided at the top end of the elevator shaft. In the embodiment shown, one of the deflection sheaves 13, 14 is designed as a deflection sheave 18, to which force is applied, of the tensioning device 17. In the embodiment shown, in particular the deflection sheave 13 serves, on the one hand, to increase the degree of wrap of the traction sheave 8. The deflection sheave 18 introduces a corresponding tensile stress into the carrying means 15 via the piston/cylinder device 20. Of course, the drive-deflection and carrying-means-tensioning arrangement could also be accommodated in a shaft pit below the elevator shaft (not shown).

Figure 5:
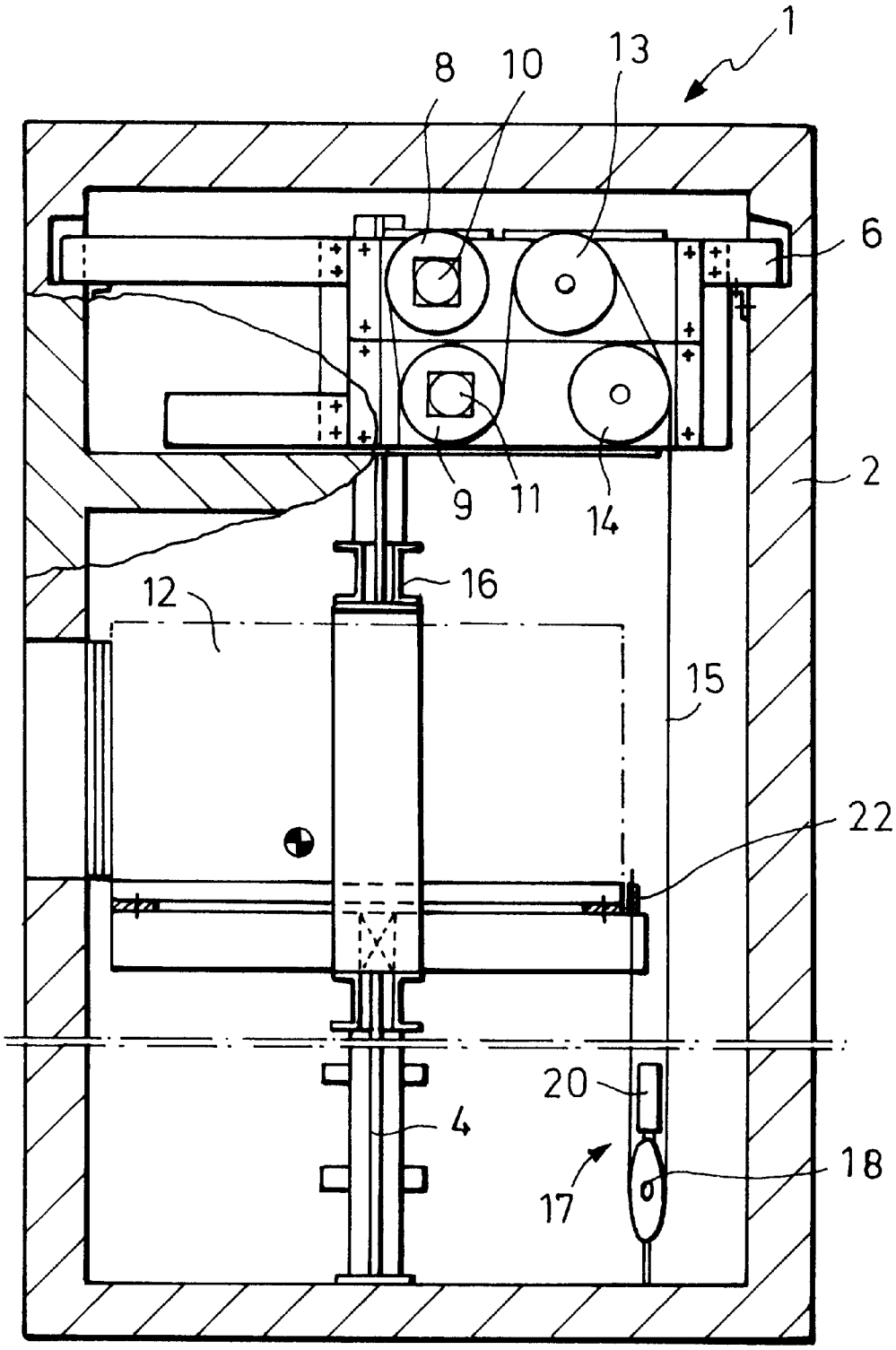
FIG. 5 is a further longitudinal sectional view, similar to FIG. 1, of a further preferred embodiment according to the invention, a displaced center of gravity, in particular, being taken into account.

Shown in FIG. 5 is a modified embodiment in which the carrying means 15 is fastened to the elevator car 12 at different locations. One end of the carrying means 15 is fastened essentially centrally to the top end of the elevator car 12. As in the preceding embodiments, the elevator car is guided inside the elevator shaft 1 via a guide rail 4. Since the elevator car 12 is provided with a door on one side, the center of gravity of the elevator car 12 is slightly displaced relative to the center axis. Starting from the suspension point of the elevator car, the carrying means 15 extends perpendicularly upward to the first traction sheave 8, winds around the latter with an angle of wrap of about 260° in order to then wrap around the second traction sheave 9, while following the shape of a question mark, likewise with an angle of wrap of about 260°, whereupon the carrying means 15 is run upward to a deflection sheave 13. The two traction sheaves 8, 9 are driven in opposite directions, in accordance with the view, via the motors 10, 11. Starting from the deflection sheave 13, the carrying means, via a deflection sheave 14, is extended perpendicularly downward to the deflection/tensioning device 17, which in the embodiment shown is formed from a pneumatic cylinder 19 and a deflection sheave 18. Starting from the deflection sheave 18, the carrying means 15 is extended further to the elevator car 12. The second end of the carrying means 15 is fastened via a carrying-means-tension-detection device 22, the end being mounted on the elevator car in such a way that the displacement of the center of gravity is compensated for by the downwardly acting force of the carrying means.

Figure 6:
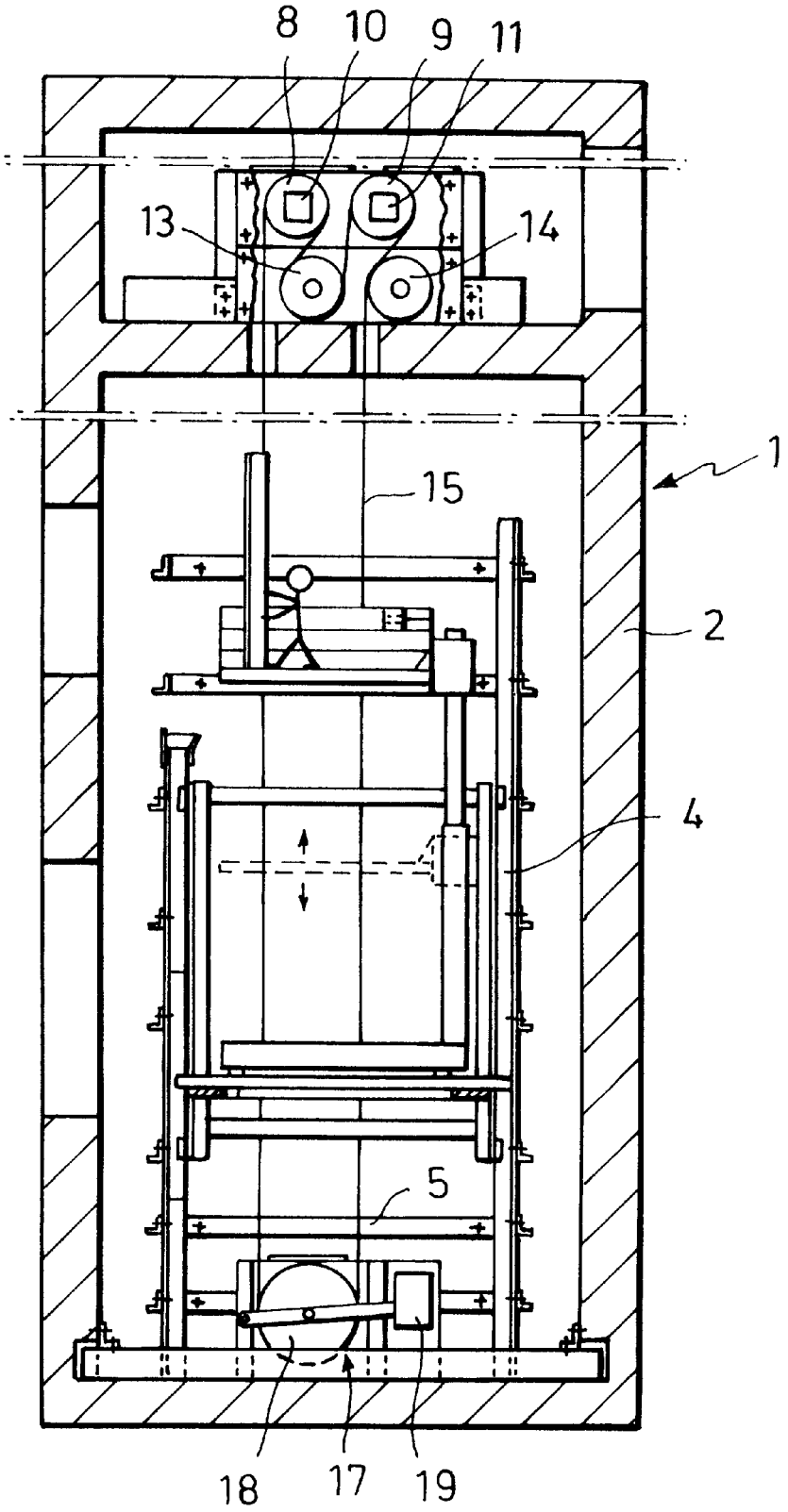
FIG. 6 shows a particular use of a preferred embodiment of the traction-sheave elevator according to the present invention.

A special use of a preferred traction-sheave elevator which can be used for the installation of the elevator framework itself is shown in FIG. 6. To this end, first the traction-sheave deflection device, for example, is installed in the machine room above the elevator shaft. The tensioning device is then installed at the bottom of the elevator shaft, whereupon the carrying means, in a simple manner, may be arranged around the individual sheaves in order to finally be pretensioned via the tensioning device. In particular with this use, it is advantageous that there are no difficult-to-guide counterweights, since the guide rails in the elevator shaft may be conceived and constructed step by step as the elevator itself moves upward. Therefore the system may already be used at the construction stage as an installation elevator, as a result of which a considerable cost reduction can be achieved. In particular, the base frame of the load-conveying means is in this case designed in such a way that a device with which it is possible to mount rail sections lying further above may be attached to it in order to speed up the construction progress without the otherwise conventional, requisite erection platforms. In order to rule out the possibility of the frame traveling too high, i.e. of it jumping out of the guide rails already installed, appropriate sensors (not shown) as well as a mechanical safety device, which directly interrupt the elevating motion as soon as the previously installed rail end is reached, are provided.

Figures 7A, 7B:
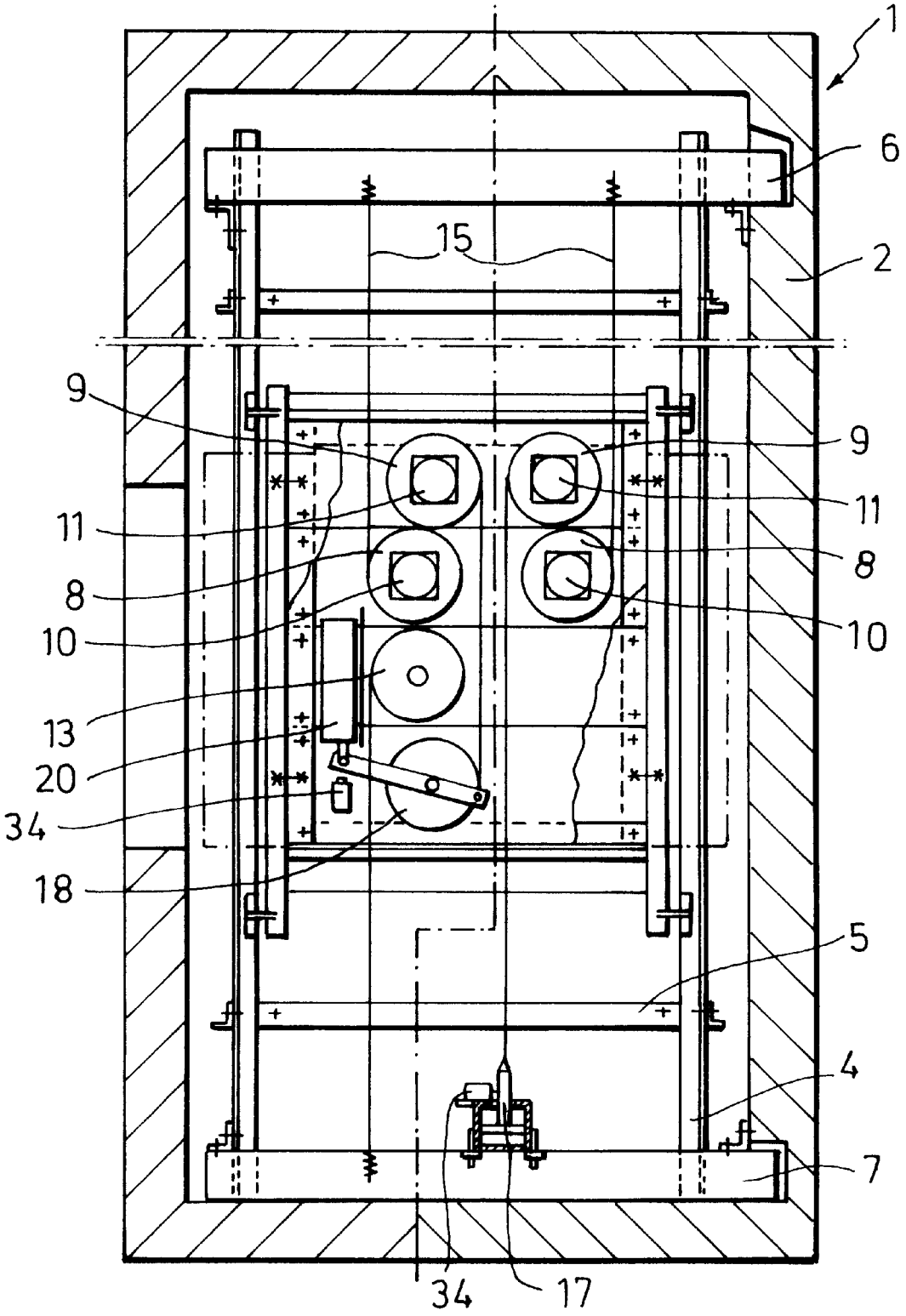
FIGS. 7A and 7B show a further longitudinal sectional view of an elevator shaft with two further preferred embodiments of the traction-sheave elevator installed therein.

FIGS. 7A and 7B show two further preferred embodiments in which the carrying means is fixed between the top and the bottom ends of the elevator shaft. In the embodiment shown in FIG. 7A (left-hand half, the carrying means 15 is fastened to the top end of the elevator shaft 1, in particular to the cross member 6, extends downward from there to a first, motor-driven traction sheave 8 and from the latter to the second traction sheave 9, the carrying means 15 wrapping around the traction sheaves 8, 9 essentially in an S-shape, so that in each case an angle of wrap of about 250° is achieved. In the embodiment shown, the traction sheaves 8, 9 are connected to the elevator car 12 in a fixed but of course rotatable manner. From the second traction sheave 9, the carrying means 15 continues perpendicularly downward to a tensioning device 17, which is likewise installed on the elevator car 12 and is in turn formed from a deflection sheave, a lever and a hydraulic cylinder 20. In particular in this configuration, a rope tension which is a function of the useful load can be obtained in an especially simple manner. In the embodiment shown, a carrying-means-tension-detection device 34, which responds if the carrying means fails, is provided below the tension-force-producing cylinder 20. Starting from the deflection sheave 18 to which force is applied, the carrying means 15 is extended via an additional deflection sheave 13, from which the carrying means is run to the bottom frame element 7, which is located at the bottom end of the elevator shaft. In the embodiment of FIG. 7B (right-hand half), the traction sheaves 8, 9 are likewise installed in a fixed but rotatable manner on the elevator car. However, in the embodiment shown, the rope-tensioning device 17 is provided as a separate device at the bottom of the elevator shaft, the tensioning device 17 in the embodiment shown being a hydraulic or pneumatic tensioning device 17 acting directly on the carrying means. In the embodiment shown, this tensioning device also comprises the carrying-means-tension-detection device 34, which is connected to the elevator control system (not shown).

Figure 8:
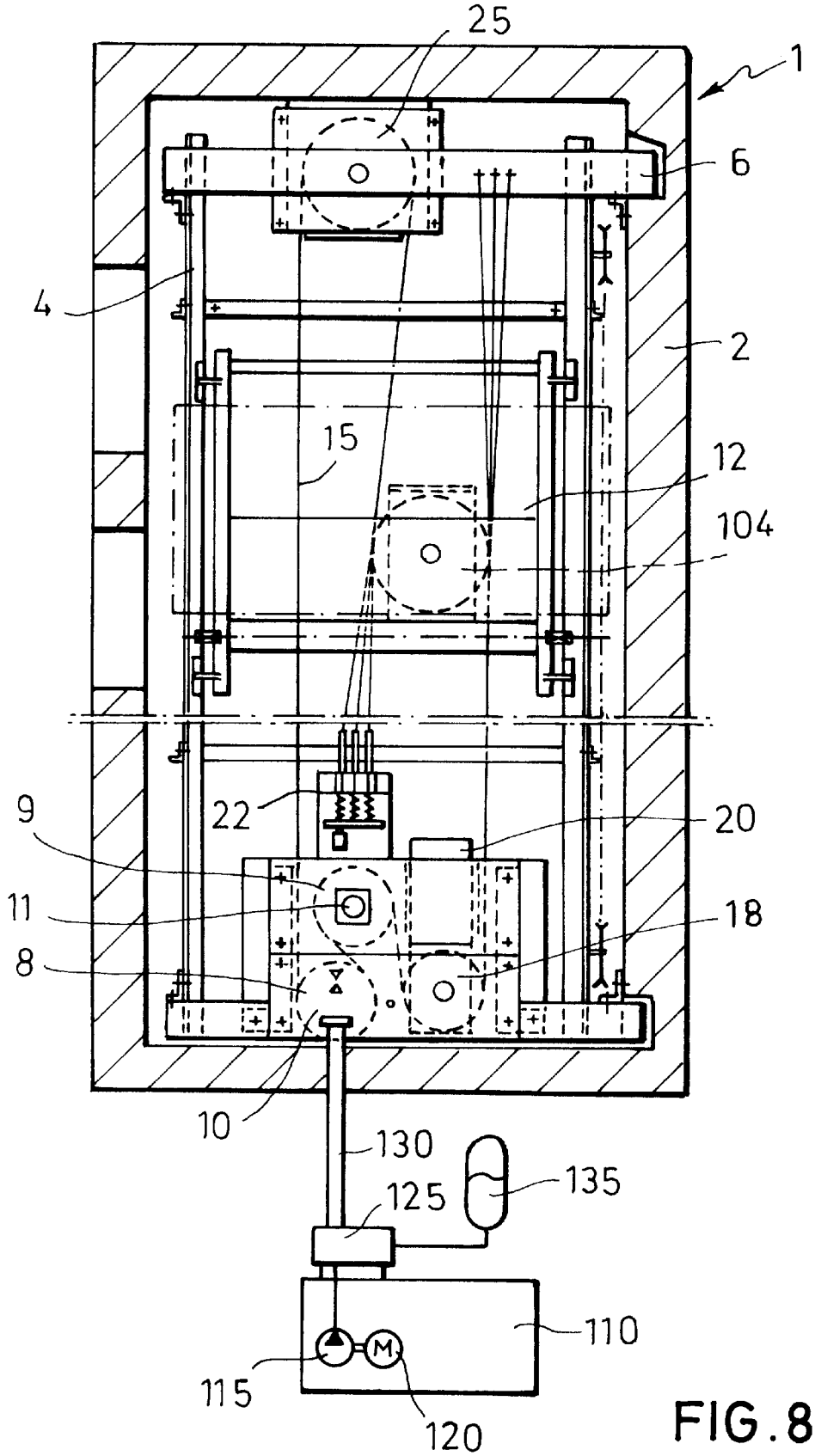
FIG. 8 shows a further longitudinal sectional view of an elevator shaft with yet a further preferred embodiment of the traction-sheave elevator installed therein.

Finally, FIG. 8 shows a further preferred embodiment in which one end of the carrying means is likewise secured to the top end of the elevator shaft. In the embodiment shown, the other end of the carrying means is fastened above a housing, which is installed at the bottom of the elevator shaft and serves to accommodate traction sheaves, tensioning device, etc. Although not shown, it is likewise possible to fasten the other end of the carrying means directly to the bottom of the elevator shaft 1. The traction-sheave arrangement and the tensioning device correspond essentially to the embodiment shown in FIG. 4. In the embodiment shown, the motor 10 is provided as a hydraulic motor, which is connected to a valve housing 125 via lines 130. The valve housing is connected to a drive unit 110, which comprises a pump 115 and an electric motor 120. Furthermore, a pressure accumulator 135 is attached to the valve housing 125, and this pressure accumulator 135, during appropriate valve operation, supplies the hydraulic motor 10 or is fed from the latter. The person skilled in the art will recognize that other drives and storage means, such as, for example, an electric motor in combination with a battery, may also be used in a similar manner. Thus, during lowering travel of the load-conveying means 12, the carrying means 15 will drive the hydraulic motor 10 under braking effect, so that the hydraulic motor 10 feeds the generated pressure to the accumulator 135 via the lines 130 and the valve housing 125. During a subsequent elevating operation, the energy stored in the accumulator 135 may then be fed again to the hydraulic motor 10 via the valve housing 125 in order to relieve the drive unit 110.

Furthermore, in the embodiment shown, a deflection device 104 is provided on the load-conveying means. In the embodiment shown, this deflection device 104 is a double contrarotating deflection pulley or two deflection pulleys which are intended to run in opposite directions and, in the embodiment shown, have the same diameters and are mounted on only one shaft, although this is not absolutely necessary. The carrying means 15 extends downward from the fastening point at the top end of the elevator shaft to this deflection pulley 104, is deflected upward from there to the deflection sheave 25 and is extended from there down to the traction sheaves. After wrapping around the two traction sheaves 8 and 9, the carrying means is run to the self-tensioning device 17 in order to be extended upward again from there to that part of the deflection device 104 which is intended to run in the opposite direction in order to be deflected again there to the fastening point at the top end of the elevator shaft. By the carrying-means guidance which is thus provided, the load-conveying means 12 is suspended indirectly or like a block and tackle, so that the force due to the weight is in each case distributed in equal proportions to the respective carrying-means sections running off upward. Thus the other units, such as, for example, the traction sheaves and the motor may accordingly be of lower rating, in which case, in particular as far as the motor is concerned, at twice the drive throughput or twice the rotary speed, only half the drive torque is required. With regard to the other features of this embodiment, reference is made to the preceding embodiments.

Although some specific embodiments of the present invention have been described above, it is obvious to the average person skilled in the art that the most diverse arrangements of the traction sheaves, the deflection sheaves and the tensioning device are possible, but these arrangements are based on the same concept according to the invention. In summary, a compact elevator can be realized with the configuration according to the invention of the traction-sheave elevator, and this elevator can be used even in restricted construction conditions and is distinguished by a greatly reduced installation cost due to the absence of a counterweight and due to the preassembled support module as drive unit, and in which a sudden upward motion when the car is lightly loaded is ruled out on account of the absence of a counterweight, and which thus has a considerably higher level of safety than previous traction-sheave elevators. If need be, the drive can be installed inside the shaft, as a result of which integration in old buildings is also possible without considerable constructional measures.

What is claimed is:

1. A traction-sheave elevator without counterweight, which is guided in an elevator shaft (1), comprising a load-conveying means (12) for carrying a load in the elevator shaft, a flexible carrying means (15) for carrying the load-conveying means, at least first and second motor-driven traction sheaves (8, 9) connected one behind the other relative to the carrying means such that the carrying means (15) defines a relative angle of wrap around each traction sheave (8, 9) of greater than 180°, and a tensioning device (17) connected downstream of the two traction sheaves for self-adjustably applying a requisite tension to the carrying means (15) after the carrying means comes off the second traction sheave (9) and a braking device provided for at least one of the traction sheaves (8, 9).

2. The traction-sheave elevator as claimed in claim 1, in which the tensioning device (17) has a deflection sheave (18) to which a force is applied.

3. The traction-sheave elevator as claimed in claim 2, in which the force is applied to the deflection sheave (18) by a means selected from the group consisting of a lever mechanism (19) provided with a weight, a hydraulic device (20), a pneumatic device and an electric motor.

4. The traction-sheave elevator as claimed in claim 3, in which the force acting on the carrying-means-tensioning deflection sheave (18) is a function of the useful load of the load-conveying means (12).

5. The traction-sheave elevator as claimed in claim 1, in which an end of the carrying means (15) is connected to the load-conveying means (12).

6. The traction-sheave elevator as claimed in claim 1, in which the elevator shaft (1) has a bottom and a top end, an end of the carrying means (15) being fastened to the bottom of the elevator shaft (1) and to the top end of the elevator shaft (1).

7. The traction-sheave elevator as claimed in claim 6, in which the tensioning device (17) is provided at the bottom of the elevator shaft (1).

8. The traction-sheave elevator as claimed in claim 1, in which the traction sheaves (8, 9) are firmly installed in proximity to the top end of the elevator shaft (1).

* * * * *